United States Patent [19]

Sherin et al.

[11] Patent Number: 4,679,797

[45] Date of Patent: Jul. 14, 1987

[54] BOARD GAME SIMULATING TRAVEL THROUGH TIME

[76] Inventors: Alan Sherin, 12330 Osborne St., #28, Hanson Hills, Calif. 91331; Bradley Geagley, 1411 N. Hayworth, #18, West Hollywood, Calif. 90039; Glenn Benest, 953 11th St., #1, Santa Monica, Calif. 90403

[21] Appl. No.: 757,152

[22] Filed: Jul. 22, 1985

[51] Int. Cl.[4] ..... A63F 3/00

[52] U.S. Cl. ..... 273/251

[58] Field of Search ..... 273/251, 248, 249, 254, 273/252, 242, 243

[56] References Cited

U.S. PATENT DOCUMENTS 4,201,388 5/1980 Cantelon ..... 273/251

*Primary Examiner*—Richard C. Pinkham

*Assistant Examiner*—Matthew L. Schneider

*Attorney, Agent, or Firm*—Keith D. Beecher

[57] ABSTRACT

A board game which allows players to travel back in time to uncover the many lives they may have lived. The game is divided into four periods of history, namely, Ancient Times, The Dark Ages, The Age of Kings and The Age of Industry. The players travel backwards in time, while attempting to accumulate wealth and treasures, and to avoid specific hazards and pitfalls. The first player to reach "Nirvana" brings the board play to an end. A "Book of Past Lives" is included in the game which lists and describes numerous past lives in ascending progression of desirability and significance, with each past life being equated to a different accumulated point score. All of the past lives described in the book are taken from actual history. Each player refers to the book for his "past life" as determined by the number of points he has accumulated when the first player reached Nirvana.

4 Claims, 3 Drawing Figures

33
TIME PORTAL
34
ROBBERY
27
ANXIETY
30
BAD OMENS
35
MISFORTUNE
25
TREASURE
32
VENGEANCE
26
TWIST OF FATE
36
ROLL AGAIN
28
ENNUI
41
LIMBO
38
MONA LISA
37
22
Age of Kings
21
AGE OF INDUSTRY
40
ARK OF THE COVENANT
23
DARK AGES
29
MELANCHOLY
24
ANCIENT TIMES
43
STATUE OF LIBERTY
39
EXCALIBUR
42
SUDDEN DEATH!
31
BARTER!
44
100 YEARS WAR

BOARD GAME SIMULATING TRAVEL THROUGH TIMECL BACKGROUND OF THE INVENTION

The board game of the invention is intended to be played by players of the ages of 10 and over, and is especially intended for those who have a lively interest in history and in reincarnation. However, the game is intended for entertainment only, and not to foster or advocate any belief in reincarnation. Up to eight players may conveniently play the game.

DETAILED DESCRIPTION OF THE ILLUSTRATED EMBODIMENT

Figures 1, 1A, 1B, 2:
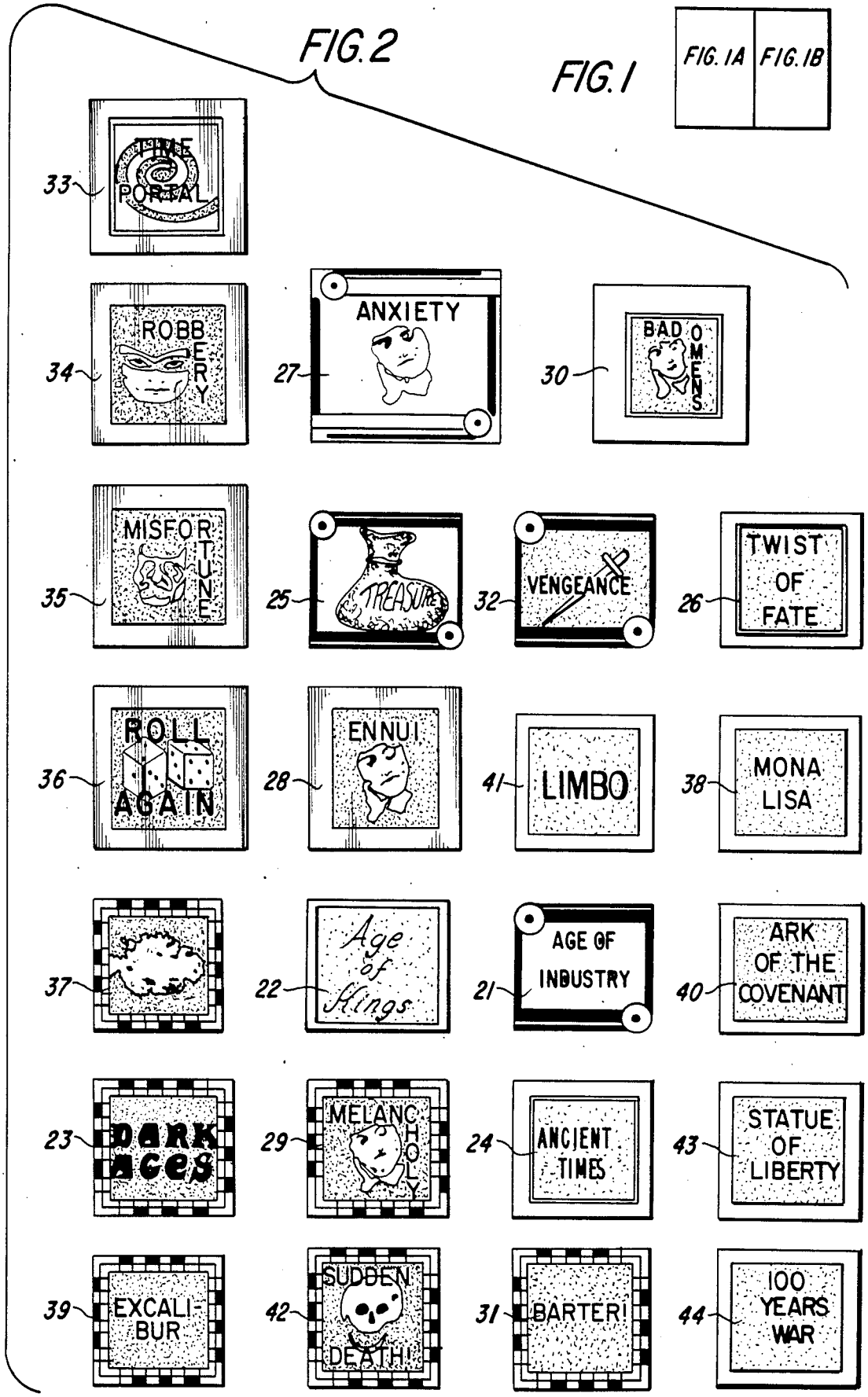
FIGS. 1A and 1B together represent a plan view of the game board of the invention in one of its embodiments.
FIG. 1 shows the two halves of the game board side by side.
FIG. 2 is a representation of the various squares appearing on the game board.
Figure 1A:
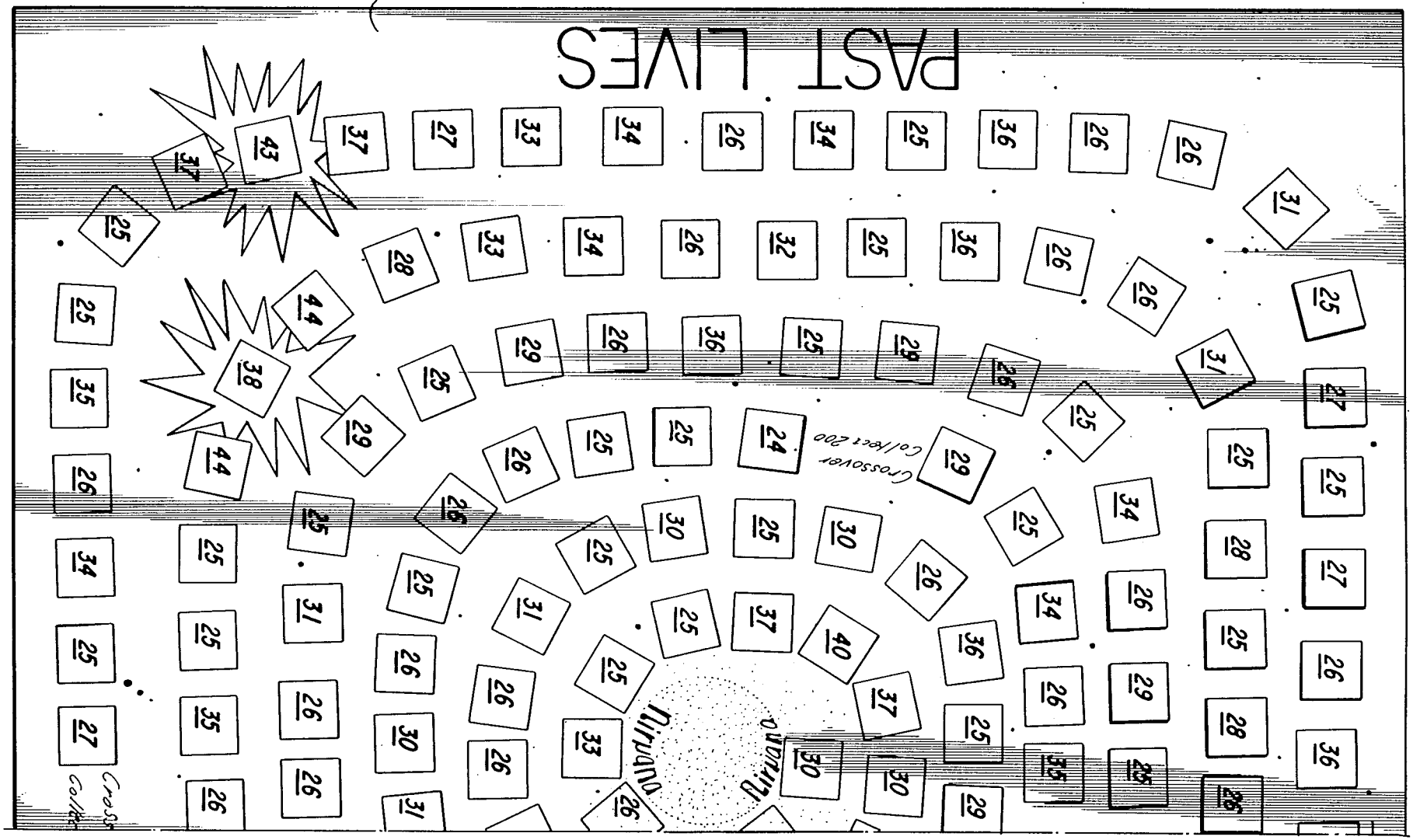
Figure 1B:
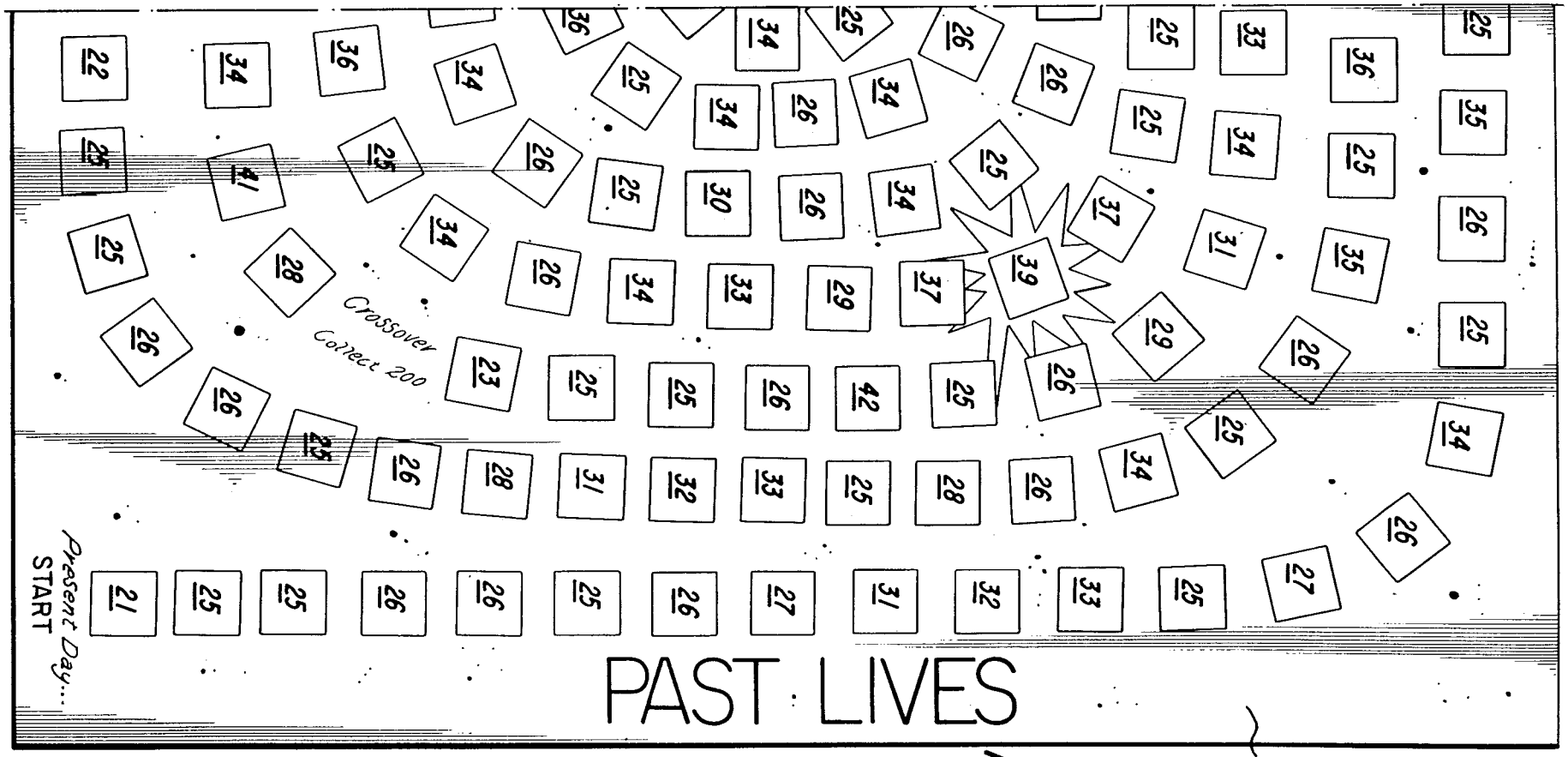

The game board 10, as shown in FIGS. 1A and 1B, has marked squares which form a spiral path extending from "Present Day Start" located at one corner of the board and extending through The Age of Industry, The Age of Kings, The Dark Ages and Ancient Times to a square at the center of board marked "Nirvana".

Each player is given a different game piece which is placed on the "Present Day" square at one corner of the board, and each player is provided with a given amount of money, in the form of cards. The cards include three cards representing three gold ingots (100 points each), two cards representing two silver ingots (50 points each), and four cards representing four bronze ingots (25 points each), for a total of 500 points. A remaining store of ingots is kept in a bank. The play proceeds on the roll of dice, or other designator. If a double is rolled, the player may choose to go forward or backward, except when he is on an Industrial Age title square, then, he can only go forward. The first person to reach Nirvana causes the game to stop. When that occurs, each player pays that person 200 points. Then, each of the players' points are totaled on a tally sheet. The scores are then matched with the past lives described in the accompanying "Past Lives Book". The lives described in the Past Lives Book are taken from history. Typical lives described in the book are as follows:

IF YOUR SCORE WAS 0 TO 125

From birth you were despised, though you did not know it. You cared only that you were burdened with an excessive amount of parasites. Scratch at them as you would, you couldn't seem to rid yourself of them. One, however, you did manage to evict. He soon found another home—this time, on the body of a human host. You could not know—or care—that this was the flea carrying the dread bacillus pastuerella pestis, because you were the RAT THAT STARTED THE PLAGUE. You were responsible for the deaths of over twenty-five million people, one quarter of Europe, in year 1328.

IF YOUR SCORE WAS 125 TO 250

When you stole aboard ship that night in 1519, crawling up the mooring rope of the Spanish galleon, you could hardly know that for the next three years you would never leave that ship. It cast off that night, sailing west to head for Eastern empires. You didn't realize, as a RAT ON MAGELLAN's SHIP, that you would finally meet your end in a country later called the Philippines. You'd gone a long way—for a rat.

IF YOUR SCORE WAS 250 TO 375

Scrawny, covered with scores and parasites, you were distinctly unappealing to look at. It has been so even from your birth in 1526 in Vienna. Neighbors spat at you, calling you rude names when you visited them in hope of getting a handdout. You only found kindness at the hands of the old woman who lived in the woods on the outskirts of town. Unfortunately, she was hauled before the tribunal on charges of witchcraft, and you were named her Familiar—the devil's creature which did a witch's bidding. You were tortured horribly before you died, howling piteously. You were the WITCH's DOG.

IF YOUR SCORE WAS 376 TO 500

You towered above the others of your kind, and that is why you were chosen by Sieur Gaspard de Foitou to ride with him in the second crusade of 1126. Boarding a cargo ship in Marseilles, you crossed to Crete on the way to Jerusalem to liberate the Holy Land from the yoke of heathenism. A blinding desert sand storm met your arrival in Acre, along with a sneak attack by the Saracens, and your unfocused dreams of glory ran out on the sands along with your blood. You were GUILLAUME LE GRAND, the CRUSADER's HORSE.

IF YOUR SCORE WAS 500 TO 625

You were born at the Gountainbleu Chateau in 1613, and sat at the right arm of the king of France, Louis XIII. In fact, you sat on the right arm of the king, causing him excruciating pain because of your grip. Your nature was distinctly predatory, and so fierce was your disposition that a special mask had to be made that prevented you from attacking. To calm you down, a gust of tobacco smoke was blown into your face, which acted as a sedative. You were a favorite of the king, and he took you with him always on his hunts. He waged great sums on your skill, and you rarely disappointed him. When you died, in 1621, you were given a miniature casket and placed into a stone wall. You were the KING's FALCON.

IF YOUR SCORE WAS 626 TO 750

You were captured by his thoughts, this stranger in the forest. Alone among others he had read your mind and knew the ways of nature. As he aged, he grew younger, practicing the magic of the Druids. You ate from his table, and shared in the arcane rites of the forest gods. You witnessed his care for the boy whom he called Wart; when that boy became Arthur the King in 612, you were there. You were MERLIN's OWL, and sat on the magician's shoulder.

IF YOUR SCORE WAS 751 TO 875

Carthage was your birthplace, about 203 B.C. From birth you were treated as a noble, and were enlisted in the Elite Cavalry Corps of Eli-bakar the High Colonel. You were drilled in precise, dance-like battle maneuvers, and were truly a fearsome sight on the battlefield. The Roman enemy scattered before you when you attached with 12,000 of your comrades. You had come from the torrid sands of Libya at the behest of the great general, Hannibal, to conquer Rome from the North. But the Alpine cold, the tortuous route, and the lack of hay spelled your doom. You died in 188 B.C. halfway through the Alps. You were Azisan, HANNIBAL's ELEPHANT.

IF YOUR SCORE WAS 875 TO 1000

You were found by an American doughboy in the French trenches of World War One. From so inauspicious a beginning, your career nevertheless was to span from silent films to television. Lee Duncan was your manager and taught you everything he knew. Darryl Zanuck wrote your first film in 1925, called "Where the North Begins". You established one of the reigning Hollywood dynasties, your sons and daughters going on to star in many cinematic blockbusters. Coddled beyond belief, you sat as an honored guest at the head table at Warner Brother's 30th Anniversary Party. You were RIN TIN TIN, the dog that saved Hollywood.

IF YOUR SCORE WAS 1000 TO 1125

You were a true star of the circus, and provided the English language with another word for huge. Captured in Abyssinia, you grew up in Paris, you resided in London for eighteen years, where you grew to eleven feet in height and weighed six and one-half tons. You came to New York in 1882, and were heralded as an intermediate star. P. T. Barnum constructed a custom-made railroad car just for your comfort. Railways, however, proved to be your undoing. Struck by an unscheduled train, you died on Sept. 15, 1885 at thirty years of age. You were JUMBO THE ELEPHANT, and your skeleton now stands at the Museum of Natural History of New York City.

IF YOUR SCORE WAS 1126 TO 1250

Worshipped as a god in 30 B.C., you were considered so holy that those whom you killed did not pass go—they went straight to heaven. Because of that, you were delivered to Cleopatra in a basket of figs, her deliverer. Though the site of your bite was later romanticized, it was actually her left arm into which you sank your fangs. Upon discovery of your complicity in the Queen's suicide, Marcus Agrippa cut off your head. You were the ASP THAT KILLED CLEOPATRA, her last friend.

IF YOUR SCORE WAS 8125 AND ABOVE

You were the Mahatma, a "Great Soul". You led your country out of foreign domination and became its first native ruler in five hundred years. Your life demonstrated your principle, that the "strongest physical force bends before more force when it is used in defense of the truth". Born in 1869, you were betrothed in childhood to your wife at age thirteen. You studied law, but your natural shyness precluded a brillient career in that profession. You moved to South Africa, where you became increasingly active in social causes because of the extreme prejudice displayed toward you. When you returned to the land of your birth you were a seasoned political leader. You called upon your people to renounce all foreign goods and to strike passively against their oppressors. You accepted the responsibility for this and was imprisoned for two years. You became increasingly spiritual, believing in celibacy and identification with the poor. At long last, your country was liberated, but before you saw the day when the foreigner left, you were tragically cut down by an assassin's bullet. You were MOHANDAS GANDHI, the Mahatma.

Each player may be provided with a pad of tally sheets, so that each player may keep track of other past lives in other games.

Major treasures, such as the "Statue of Liberty", "Mona Lisa""Excalibur", and "The Ark of the Covenant" may be represented as actual replicas, or cards mounted on individual stands. The major treasures are placed in an upright position on respectively correspondingly designated squares on the game board 10 of FIGS. 1A and 1B.

A number of Twist of Fate instruction cards are provided for each of the different ages and which contain certain directions and instructions, and, in some instances, either add or take points from the player selecting the particular card. When a a player's game piece lands on a Twist of Fate square (26) in any one of the different ages, the player is directed to select one of the Twist of Fate cards for that particular age. Examples of the Twist of Fate Cards in the various Ages are as follows:

AGE OF INDUSTRY

You miss the boat—and it's the Titanic! (Whew!) Take another turn!

You marry into the Rothschilds. Take another turn.

Queen Victoria is *very* amused! (Whew!) Take another turn!

Sherman marches through Georgia, *and* your plantation. Lose one treasure. (Your choose—put into Limbo)

Bootlegging lays the cornerstone of your fortune. Collect 500.

Your mango plantation is destroyed when Krakatoa erupts. Lose one turn. (CATASTROPHE)

The Treaty of Versailles makes a pauper of you, Baroness. Lose one treasure. (You choose—put into Limbo)

A $3 outlay for a shovel and a pick brings you a bonanza in the goldrush. Collect $375.

AGE OF KINGS

Lorenzo de Medici becomes your patron. Take another turn.

You contract scurvy while serving as a midshipman in the Royal Navy. Go back 5 spaces. (DISEASE)

Advance to the nearest TIME PORTAL and crossover into any age you choose! Collect 200.

A great idea, Isabella, loaning your jewels to that Italian captain Colombo. Collect 500.

Go back to the start of Age of Kings—do *not* collect 200.

This card protects you against any disease or catastrophe. Once played, it must be put at bottom of card stack.

Crossover into the Dark Ages—and collect 200!

DARK AGES

The Queen regards you as "unchivalrous". Lose one turn. (CATASTROPHE)

Your moat runs dry, and your castle is taken during the siege. Lose one turn. (CATASTROPHE)

Bearing fifteen children in eleven years' time wears you out, Brunhilde. Go back 5 spaces. (DISEASE)

A patron pays for your entrance into the University of Heidelberg. Take another turn. (You choose—put into Limbo)

PROTECTION AGAINST THE EVIL EYE!

The Baron wants to annex your farm—but you convince him to take your wife instead. (Whew!) Take another turn.

Your uncle becomes Pope Innocent VI. Take another turn.

You've won the joust and the favor of the queen. Collect 50.

ANCIENT TIMES

Render unto Ceasar what is Caesar's. Pay 50 into Limbo.

Elephants just don't work in the Alps, Hannibal. Lose one treasure. (You choose—put into Limbo)

Your Huangshu silk factories prosper. Collect 250.

This card protects you against any disease or catastrophe. Once played, it must be put at bottom of card stack.

Overworked and harried in 79 A.D. business prevents you from taking a vacation trip to your summer home—at the foot of Versuvius. (Whew!) Take another turn.

The Emperor of the Ch'in demands a treasure to finance the Great Wall. Lose one treasure. (You choose—put into Limbo)

Your matched team of Arabians win the chariot race. Collect 100.

The expedition to Punt is successful, Queen Hatshepsut. Collect 375.

A plurality of "Treasure" cards are provided for each of the different ages. When a player's game piece lands on a Treasure Square (25) in any one of the different ages, the player is directed to select a Treasure card. The treasure cards represent certain specific treasures which are pictured on the individual cards, and which call for the award of various points, depending upon which treasure card is selected. Typical treasure cards for the four ages are as follows:

| | Points |
|---|---|
| AGE OF INDUSTRY | |
| IBM Stock | 100 |
| Treasure Map | — |
| Crown Jewels | 500 |
| The Thinker | 500 |
| The Titanic | 50 |
| The Hope Diamond | 300 |
| AGE OF KINGS | |
| The Mary Rose | 175 |
| Opium | 350 |
| Tea | 100 |
| Treasure Map | — |
| Spices | 100 |
| DARK AGES | |
| Chamber Pot | 0 |
| Treasure Map | — |
| Tang Horse | 400 |
| Shield of the Red Rose | 150 |
| Viking Long Boat | 300 |
| Chastity Belt | 25 |
| ANCIENT TIMES | |
| Sacred Golden Calf | 75 |
| Chinese Terracotta Soldier | 500 |
| Cleopatra's Barge | 325 |
| Treasure Map | — |
| Gold Scarab | 50 |
| David's Sling | 25 |
| Evil Eye | — |

The individual squares on the game board 10 of FIGS. 1A and 1B are shown in FIG. 2, and 1 are as follows:

Title Squares, that is squares designated, Age of Industry (21), Age of Kings (22), Dark Ages (23) and Ancient Times (24) are provided on the board. If the game piece of a player lands on any one of the Title Squares, no action is taken. However, if the player has "Crossed Over" into another Age, he collects 200 points from the bank in the form of bronze, silver and gold ingots.

If a player lands on a Treasure Square (25), he must pay 100 points in gold, silver or bronze ingots, and he then picks up a Treasure Card for the corresponding Age and receives the treasure indicated on the Treasure Card. If the player does not have enough money to buy the treasure, the treasure goes up for bid to anyone who wants it for any price over 100 points. When anyone picks up a "Treasure Card" he keeps the card and places it face down adjacent to his position.

Should a player land on a "Twist of Fate" square (26), he picks up the Twist of Fate card from the corresponding Age, and carries out whatever action is directed on that card. He then replaces the card at the bottom of the deck.

When a player lands on any of the squares designated "Anxiety" (27), "Ennui" (28), "Melancholy" (29) or "Bad Omens" (30), the player does nothing, and the game play reverts to the next player.

When a player lands on a "Barter" square (31), all players pass one of their treasures to the right. If a player has no treasures, he simply does not pass. Nevertheless, he still receives a treasure from the player on his left.

When a player lands on a "Vengeance" square (32), he receives 200 points from any other player he selects.

When a player lands on a "Time Portal" square (33), he may proceed further or backward in time to the title square of any Age he selects. He collects 200 points, as in a "Cross Over" move.

When a player lands on a "Highway Robbery" square (34), the player picks any treasure from any other player he chooses. However, the picking must be done blind.

When a player lands on a "Misfortune" square (35), he rolls dice to go backwards, but he does not perform the action on the square to which he returns.

When a player lands on a "Roll Again" square (36), he has another roll.

When a player lands on a "Nuclear Spill" square (37), "Hundred Years War" square (44), "Plaque" square, or "Famine" square which protect the Major Treasures in each of the four Ages, he loses one turn.

If a player lands on any of the Major Treasure squares, namely "Statue of Liberty" (43), "Mona Lisa" (38), "Excalibur" (39), or "Ark of the Convenant" (40), he takes over the particular treasure. These are the most valuable prizes in the game. They may not be taken during a Highway Robbery. However, none of these Major Treasures may be added to the score of any player, unless he has in his possession a Treasure Map at the end of the game, which is obtained by selecting an appropriate one of the Treasure Cards which is found in all Ages.

A player landing on a "Sudden Death" square (42) loses all his wealth, except for his original 500 points. He goes back to Present Day, and his wealth goes into Limbos.

A player landing on the "Limbo" square (41) receives all the treasures and cash received in Limbo throughout the game.

The "Evil Eye" is presented at the end of the game. The player who receives the "Evil Eye" gets to pick any treasure he chooses, including a Major Treasure, from any opponent.

To recapitulate, at the beginning of the game, each player is dealt 500 credits in gold, silver and bronze ingots. Dice are included in the game, and the player who rolls the highest number goes first. The movement around the game board 10 of FIGS. 1A and 1B is counterclockwise. The goal is to reach Nirvana, located at the center of the board. The starting player begins at the "Present Day" area located at the beginning of the Industrial Age. The player must travel back through four major eras, namely, the Industrial Age, the Age of Kings, the Dark Ages and Ancient Times.

Up to six players may play at any one time. The players roll the dice, and as in conventional board games, move their game pieces the number of squares indicated by the dice.

The players gather points by amassing treasures from the various Ages. When the treasures from the treasure card decks run out, the treasure squares become worthless. When landing on a treasure square, the player must pay one gold ingot (100 points) to obtain the treasure. Since the treasure cards are placed face down in their tray, according to their particular Age, the player will no know the value of the selected treasure. Some are worth more than a gold ingot, others less. If the player who lands on a treasure square has run out of money, the treasure square is put up for bid to the other players.

In addition to the treasure cards, there are four Major Treasures from the different eras which may be collected. These are worth much more than the other treasures. They include the Statue of Liberty from the Industrial Age, the Mona Lisa from the Age of Kings, Excalibur from the Dark Ages, and the Ark of the Covenant from Ancient Times. These are physical play pieces. It is extremely difficult to capture these items because hazardous squares surround their vicinity, a Nuclear Spill in the Industrial Age, the Hundred Years War in the Age of Kings, Plaque in the Dark Ages, and Famine in Ancient Times. Landing on any of these squares will result in a loss of turn. Also, to validate a Major Treasure, one must have in his possession by the end of the game a Treasure Map card obtained by selection of the appropriate Treasure card.

Twist of Fate cards are obtained when a player lands on a Twist of Fate square. These cards contain certain commands, gifts, injuries or powers. Twist of Fate cards are played according to their directions. Some may be played at any time by any player, others may be played only at specified times. All must be read aloud. After a Twist of Fate card has been played, it must be placed at the bottom of the deck from which it was taken.

There are two cards which are extremely important, and appear once in each Age. These are: the Evil Eye card located in the Treasure Card deck, which enables its possessor to claim any treasure, including a Major Treasure, from any person at the end of the game before the points are totaled. Unless a Major Treasure, which is a physical play piece, is selected, the selection of the other person's treasure is done blind, by taking one of his turned-over treasure cards.

Conversely, there is one protection against the Evil Eye card in the Twist of Fate cards. A person who possesses that card can prevent his treasure from being taken. However, the person with the Evil Eye can then claim a treasure from another player.

In addition to the accumulation of treasures, there are several squares on the game board 10 of FIG. 1 which indicate various activities, for example:

Highway Robbery—a player landing on this square gets to pick a treasure from any player he chooses, by selecting one of the other player's Treasure cards. This selection is blind.

Vengeance—the player landing here gets to pick the person who must give him 200 cash credits.

Day of Misfortune—the player who land on this square must roll to find out how many squares he himself will be sent backwards.

Barter—any time a player arrives on this square, all players must pass one of their treasures to the player on his right. This enables worthless treasure to be passed on. Sometimes, however a player may have only valuable treasures and must surrender one of them.

Time Portal—the player landing on this square (33) has the option of going forward or backward in time. He may choose to go back to a later era to obtain more treasure points, or he may go into Ancient Times so that he may be first to enter Nirvana, thus ending board play. The first person to reach Nirvana also receives a bonus, from every player, as mentioned above.

Any time a player lands on the Sudden Death square (42), he must forfeit everything except his original 500 credits and go back to the beginning of the game. All his treasures go into the Limbo pile, meaning they are unavailable for future game play, and are collected when a player lands on the Limbo square. Any time a person must surrender a treasure or cash outlay according to the Twist of Fate cards, these are paid into the Limbo pile. However, when playing for Treasure Cards, the fee is returned to the bank. As stated, when a person lands on the Limbo square, he collects all the treasures and cash that are deposited on the Limbo pile.

When a player runs out of money with which to continue the game, he must cash in one or more of his treasures for their face value. If he has no treasure, he continues to roll dice but cannot perform function.

In every Age there are a number of squares which, when the player lands on them, he does nothing. In the Industrial Age, the squares are called "Anxiety", in the Age of Kings, the squares are called "Ennui", in the Dark Ages, the squares are called "Melancholy", and in Ancient Times the squares are called "Bad Omens".

The board play ends when any player enters Nirvana. All treasures and money are added up. Evil Eye cards are presented, and credits deducted. Reference is then made to the Book of Past Lives to find out where each player was in a Past Life. The higher the score, the more prestigous the past life.

It will be appreciated that although a particular embodiment of the game has been shown and described, modifications may be made. The following claims are intended to cover all such modifications which come within the true spirit and scope of the invention.

We claim:

1. A game board combination including: a game board having marked squares thereon constituting a path from a beginning location to an end location and simulating a journey backward in time through a number of distinct past ages, each of the past ages comprising a plurality of successive squares respectively containing directions to the players to be followed as a player's game piece lands on a particular square; a plurality of treasure cards for each of the different ages, with at least one of the squares on the game board in each of the different ages directing a player to select a treasure card for the corresponding age; a plurality of instruction cards for each of the different ages and wherein at least one square on the game board for each of the different ages directs a player to select one of the instruction cards in that particular age each player accumulating points, as different treasure cards are selected; and a book containing descriptions of past lives indexed to different point totals so that a player may determine his past life as indicated to the total number of points accumulated when the game ends.

2. The game board combination defined in claim 1, in which the end location designates the end of the game upon the arrival thereat of the leading one of the game pieces.

3. The game board combination defined in claim 1, and which includes a plurality of special treasure game pieces placed on corresponding squares on the game board awarding a predetermined number of points to the player whose game piece lands on such squares.

4. The game board combination defined in claim 1, in which other marked squares on the game board contain special instructions to the player whose game piece lands on such squares.

* * * * *